US005219368A

United States Patent [19]

Page

[11] Patent Number: 5,219,368

[45] Date of Patent: Jun. 15, 1993

[54] BLADDER-CUSHIONED HELMET ASSEMBLY

[76] Inventor: Jared Page, 2922 Lake Ave., Osseo, Mich. 49266

[21] Appl. No.: 709,232

[22] Filed: Jun. 3, 1991

[51] Int. Cl.[5] ..... A42B 3/00

[52] U.S. Cl. ..... 2/413; 2/2.1 R; 128/201.24; 128/201.27

[58] Field of Search ..... 2/2.1 R, 2.1 A, 6, 410, 2/413, 421, 424; 128/201.23, 201.27, 206.24, 207.11, 201.24

[56] References Cited

U.S. PATENT DOCUMENTS

| | | | |
|---|---|---|---|
| 3,438,060 | 4/1969 | Lobelle et al. | 2/6 |
| 3,528,414 | 9/1970 | Schueller | 2/2.1 A X |
| 3,943,571 | 3/1976 | Boatman | 2/2.1 R |
| 4,038,700 | 8/1977 | Gyory | 2/413 |
| 4,124,904 | 11/1978 | Matthes | 2/413 |
| 4,514,864 | 5/1985 | Huber | 2/424 |
| 5,044,017 | 9/1991 | Kirby et al. | 2/2.1 R X |

*Primary Examiner*—Peter Nerbun

*Attorney, Agent, or Firm*—Gifford, Groh, Sprinkle, Patmore and Anderson

[57] ABSTRACT

A helmet assembly having a front half and a back half hingedly and lockably connected together. Each half of the helmet includes a bladder filled with a fluid. Each bladder has a neck portion which engages the front half and the back half of the user's neck respectively. When the two halves of the helmet are fitted about the user's head, the bladders cushion the wearer's head, minimize air presence within the helmet, and seal out water (or gas) about the user's neck.

21 Claims, 2 Drawing Sheets

BLADDER-CUSHIONED HELMET ASSEMBLY

BACKGROUND OF THE INVENTION

I. Field of the Invention

The present invention relates to helmets. More particularly, the present invention relates to a helmet assembly designed for underwater diving but suitable for other uses where cushioning, broad protection, and easy removability are desired.

II. Description of the Prior Art

Underwater divers have long sought suitable diving headgear for protection from both underwater objects and from the cold itself. The conventional diver's hood does not provide much of the protection desired.

Since the early days of underwater diving, one form of protection has been available for the diver's head. The twist-on cast iron, multi-portholed diver's helmet has become almost legendary. This helmet, together with iron boots and a dry suit, is still in use. However, this helmet is awkward and uncomfortable to wear based upon the sheer weight of the cast iron helmet.

Clearly the cast iron helmet is valuable only in a limited number of circumstances.

In an effort to overcome the problems of known provisions for headgear, several modifications of the basic helmet have been attempted.

A relatively early helmet is disclosed in U.S. Pat. No. 3,534,408 issued on Oct. 20, 1970, to Fifield. This helmet has a sealable neck that attaches to a dry suit.

A later attempt at providing headgear is set forth in U.S. Pat. No. 3,680,526 issued on Aug. 1, 1972, to Morgan. This patent discloses a face plate and helmet combination with the face plate being attached by a plurality of detachable straps. However, the patent to Morgan does not provide a good seal about the face because it does not adapt to the shape of the user's face. Slight movement of the jaw will break the seal.

More recently, U.S. Pat. No. 3,943,571, issued to Boatman on Mar. 16, 1976, discloses a three-pieced protective helmet for underwater diving comprising an inner hood, a back portion, and a front plate hingedly attached to the back portion. Furthermore, the patent to Boatman discloses a helmet that requires the user to be assisted when the helmet is put on.

While providing some measure of protection, these helmets all suffer from common defects, including the lack of a quick-release method for escape and the absence of means for keeping out water while providing proper support and padding to the user's head.

SUMMARY OF THE PRESENT INVENTION

The present invention overcomes those problems commonly associated with helmets by providing a practical helmet that provides broad protection, cushioning, and easy fitting and removal.

The helmet assembly of the present invention includes a front half and a back half hingedly attached to one another. Latches are provided on both sides of the helmet assembly to readily and releasably fasten the two halves together. The external helmet shell is preferably composed of a durable polymerized material.

The front half of the helmet has a viewing port having a clear plate and an air regulator port. The viewing port preferably includes a defogging unit to clear the condensate from the inner side of the clear plate normally resulting from humid warmed air on the inside of the helmet. The defogger may comprise an air tube with one or more jet ducts directed at the plate. The wearer may operate a valve mounted on the helmet to regulate air flow to the defogger.

To cushion the user's head and to keep water out of the helmet while at the same time minimizing the presence of air in the helmet, an internal bladder system is provided. For diving, it is desired to minimize or eliminate pockets of air in the diver's equipment. As is well known the presence of even small volumes of air in the diver's equipment increase buoyancy in undesired ways.

The bladder system comprises a first bladder disposed in the front half of the helmet shell and a second bladder disposed in the back half of the helmet shell. The two bladders are interconnected by a common fluid transfer section. Both bladders have neck regions to provide a watertight seal between the neck regions of the helmet and the wearer's neck when the helmet's two halves are interlocked. The first bladder has a opening providing visual access to viewing port provided in the front half of the helmet shell and to accommodate the mouthpiece of the regulator.

The bladder is filled with a fluid, preferably silicon, thereby withstanding the effects of cold water. (Water as a filler would freeze and oil would thicken.) To accommodate different-sized heads, the bladders are generally over-filled and, once in place on the user's head, fluid would either be exhausted through an inlet/outlet tube or would be forced into a fluid expansion region. Once removed, fluid would be replaced through the tube or would be returned by the resistance of the fluid expansion region back into the bladder.

Because the bladder forms a watertight seal, no hood is necessary.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS OF THE PRESENT INVENTION

Figure 1:
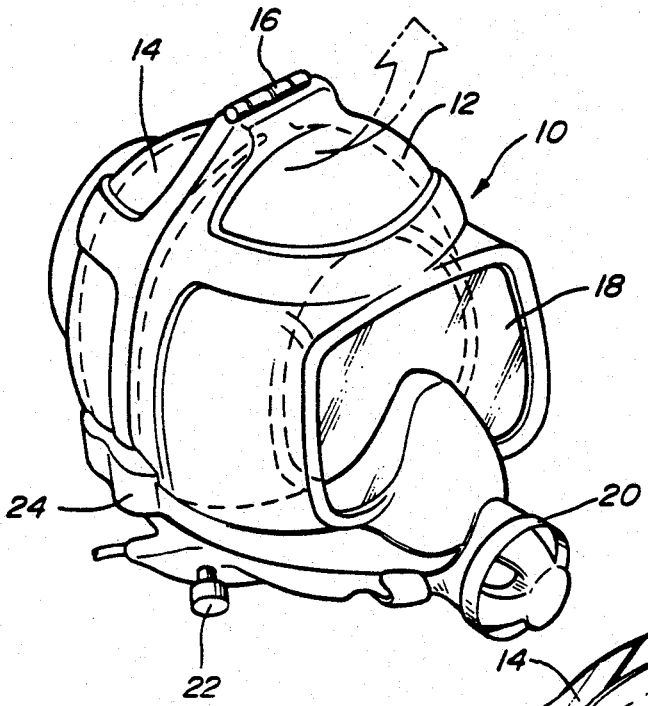
FIG. 1 is a perspective view illustrating a helmet assembly according to the present invention.

The drawing discloses the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

FIG. 1 is a perspective view of the helmet. The helmet generally indicated as 10 comprises an external shell or body having a front half 12 and a back half 14. The front and back halves 12, 14 are preferably composed of a hard polymerized material such as a plastic. The two halves 12, 14 are attached to one another by a hinge 16. While a conventional hinge 16 is illustrated, it should be understood that an alternate hinging means, such as a "living hinge", may be employed.

The front half 12 of the helmet 10 includes a window such as a face plate 18. The face plate 18 may be either a single plate as illustrated or may be a triple plate-type design where there is a single plate in front and two side plates. A clear bubble design may also be employed, although this construction tends to distort the view.

A second stage regulator 20 is attachable to the front half 12 of the helmet. The regulator 20 may be interchangeably removable, thereby enabling the user to selectively employ a preferred regulator. Additionally, a communicating mouthpiece may be employed.

A plate clearing valve 22 may also be provided to control the flow of air across the inside of the face plate 18. This feature allows the user to remove any fog that may accumulate on the inner side of the plate 18.

A pair of quick-release latches 24 and 26 are provided on either side of the helmet 10. Only latch 24 is visible in FIG. 1. This placement of the latches 24 and 26 allows the user to easily disconnect the two halves from each other permitting the removal of the helmet 10. The details of the latches 24 and 26 are fully described with reference to FIG. 7.

Figure 2:
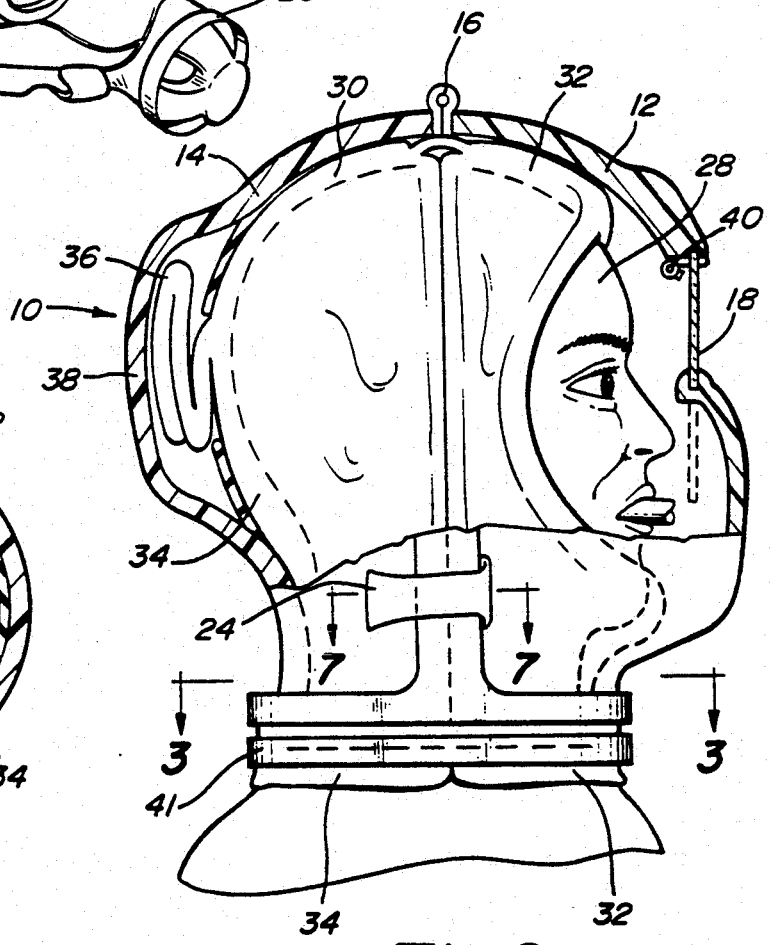
FIG. 2 is a side elevational view, partially in cross-section, illustrating the present invention in place on a diver's head.

FIG. 2 is a side view of the helmet 10 shown in partial cross section. FIG. 2 shows the details of the fitting relationship between the helmet 10 and a user's head 28.

With the exception of the eyes, nose and mouth, the user's head 28 is substantially enveloped by a bladder 30. The bladder 30 is comprised of a first bladder portion 32 and a second bladder portion 34. The first and second bladder portions 32 and 34 are attached to the inner walls of the front half 12 and the back half 14 of the helmet respectively. The bladder 30 is filled with a fluid having a very low freezing point such as silicon. It is recognized that in the alternative a pair of hard rubber inserts may be used in lieu of the bladder portions 32, 34. The hard rubber inserts would necessarily be molded according to the particular contours of the user's head.

A critical feature of the helmet 10 according to the present invention is its ability to eliminate air pockets between the user's head 28 and the inner wall of the external shell of the helmet 10. The bladder 30 provides this feature by being snugly fitted against the user's head 28. To achieve this end, the bladder 30 is filled with an excess amount of fluid. Accordingly, once the helmet 10 is placed about the head 28 of the user, a small volume of fluid is forced out of the bladder 30 and into a fluid expansion member 36 located within a fluid expansion chamber 38 preferably disposed on the back side of the back half 14. Although an expanding tube is shown to represent the expanding fluid member 36, a bellows-type design may also be used.

To eliminate fog as discussed above with reference to FIG. 1, an air vent 40 is provided in close relation to the plate 18. The air provided through the air vent is supplied by the user's supply of air.

Figure 3:
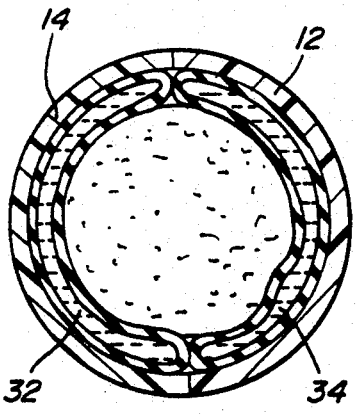
FIG. 3 is a view of the neck region taken along line 3—3 of FIG. 2.

An effective seal to prevent water from entering into the helmet 10 is created primarily by the close contact of the bladder portions 32, 34 about the neck of the user. This is illustrated in FIG. 3 which is taken along section line 3—3 of FIG. 2. As shown in FIG. 3, the edges of bladder portions 32 and 34 engage to form a fluid tight seal relative to each other and about the neck of the user. The fluid tight seal particularly prevents water from entering the space disposed between the plate 18 and the user's face. To provide a maximum seal, the front and back portions 32 and 34 of the bladder 30 preferably extend slightly below a neck region 41 of the helmet 10 as shown. The elimination of water also helps the user to retain body heat.

Figure 4:
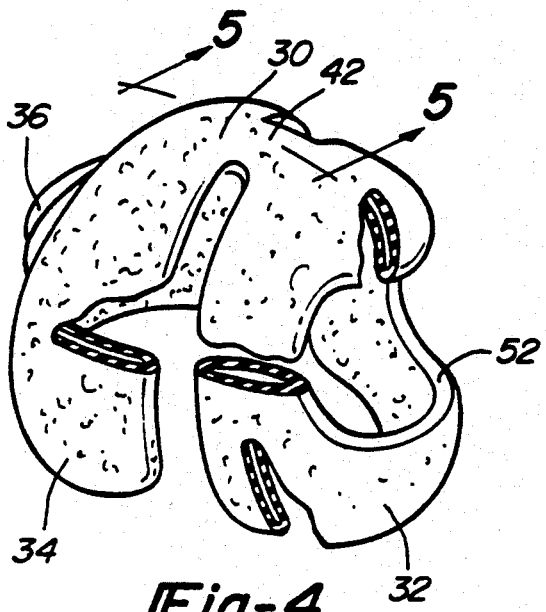
FIG. 4 is a perspective view, partially in cross-section, illustrating the bladder portion of the present invention.

FIG. 4 shows a fuller view of bladder 30. This view of the bladder effectively shows the preferred form of the bladder 30 and particularly discloses the front opening 52 provided in the first bladder portion to accommodate the user's eyes, nose and mouth.

Figure 5:
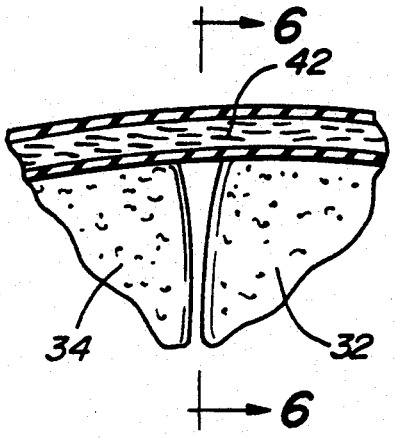
FIG. 5 is a view taken along line 5—5 of FIG. 4 and illustrating the joined portion of the front and back halves of the bladder.
Figure 6:
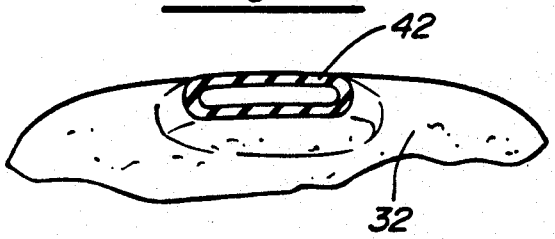
FIG. 6 is a view taken along line 6—6 of FIG. 5 illustrating a view of the flow port connecting the front and back halves of the bladder.

At least one common fluid transfer section 42 is provided at the top of bladder 30 which fluidly connects the first portion 32 to the second portion 34. This fluid transfer section 42 balances the fluid pressure between the first bladder portion 32 and the second bladder portion 34. FIGS. 5 and 6 illustrate the details of the fluid transfer section 42 as taken axially along the sectional line 5—5 of FIG. 4 and sectionally along sectional line 6—6 of FIG. 5. The fluid transfer section 42 may be of a different shape so long as fluid may easily be passed therethrough.

Figure 7:
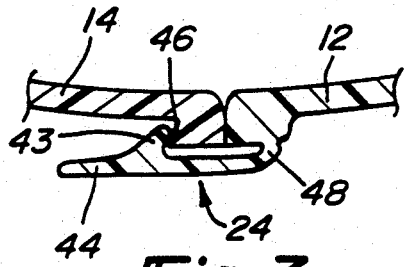
FIG. 7 is a view of the latch mechanism of the present invention.

FIG. 7 shows the detail of the quick-release latch 24. The quick release latch 24 has an arm 44 attached to the front half 12 of the helmet. The arm 44 has a dog 43 which frictionally engages a dog catch 46 provided on the back half of the helmet. Preferably the latch arm 44 is pivotably attached to the front half 12 by a living hinge 48 which is formed as part of the first half 12 of the helmet.

Figure 8:
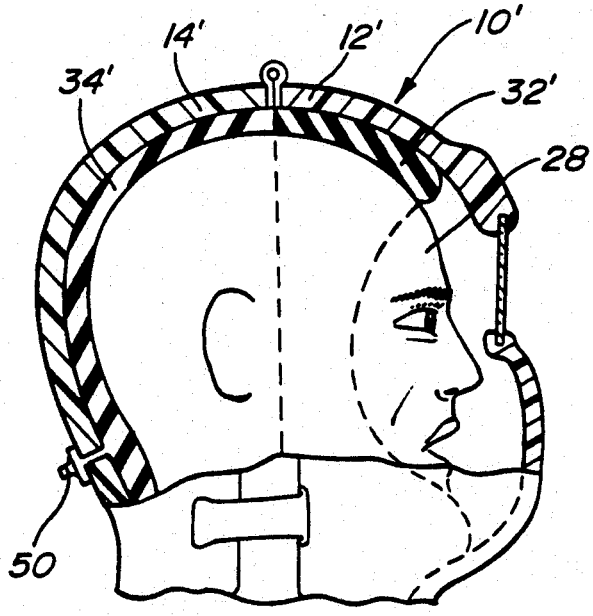
FIG. 8 is a raised elevational view, partially in cross section of the helmet of the present invention detailing the relationship between the helmet, the user's head, and the bladder.

FIG. 8 illustrates an alternate embodiment of the present invention. A helmet 10' includes a front half 12' and a back half 14'. A first bladder portion 32' and a second bladder portion 34' are disposed within the halves 12', 14' respectively.

According to this embodiment, a fill tube 50 is provided in lieu of the fluid expansion region 36 of the embodiment described in FIGS. 2 and 4 above. Fluid may be added or released from the tube 50 as required for a snug fit about the user's head 28. This permits the user to adjust the pressure of the bladder on his head.

Having described my invention it is envisioned that modifications may be made which nevertheless fall within the scope of the invention as claimed.

I claim:

1. A helmet assembly comprising:

an external helmet body having a front half and a back half, said front and back halves being releasably attachable to one another;

said front half having an inner wall and said back half having an inner wall;

a first bladder portion fitted to said inner wall of said front half;

a second bladder portion fitted to said inner wall of said back half;

said front and back halves each including a neck contacting region, whereby said neck contacting region of said front half and said neck contacting region of said back half sealingly engage with each other to form a fluid-tight seal about the neck of the user when said front half and said back half are fitted to one another;

whereby the user's head may be snugly situated between said first bladder portion and said second bladder portion when said front and back halves are attached to one another.

2. The helmet assembly of claim 1 wherein said front half and said back half are hingedly attached to one another.

3. The helmet assembly of claim 1 wherein said font half has a top edge and said back half has a top edge, said top edges each being fitted with a hinge potion, said hinge portions being interattached.

4. The helmet assembly of claim 3 wherein said helmet includes releasable fasteners for lockingly attaching said first half to said second half at a location remote from said hinge portion.

5. A helmet assembly comprising:

an external helmet body having a front half and a back half, said front and back halves being releasably attachable to one another;

said front half having an inner wall and said back half having a hinge edge, said hinge edges being fitted with a hinge portion, said hinge portions being interattached;

said front half having an inner wall and said back half having an inner wall;

a first bladder portion fitted to said inner wall of said front half; and a second bladder portion fitted to said inner wall of said back half;

said first and second bladder portions each including a neck contacting region, whereby said neck contacting region of said first bladder portion and said neck contacting region of said second bladder potion sealingly engage with each other to form a fluid-tight seal about the neck of the user when said front half and said back half are fitted to one another;

said helmet further including releasable fasteners for lockingly attaching said first half to said second half;

whereby the user's head may be snugly situated between said first bladder portion and said second bladder portion when said front and back halves are attached to one another.

6. The helmet assembly of claim 5 wherein said first and second bladder portions are joined to each other by a common fluid transfer section.

7. The helmet assembly of claim 6 wherein at least one of said first and second bladder portions further includes a fluid level adjustment tube.

8. The helmet assembly of claim 6 wherein at least one of said first and second bladder portions further includes a fluid expansion member.

9. The helmet assembly of claim 5 further including an air regulator assembly port provided through said front half of said helmet body.

10. The helmet assembly of claim 9 wherein said front half of said helmet further including a window permitting the user to see out of the helmet.

11. The helmet assembly of claim 10 further including means for defogging said window.

12. The helmet assembly of claim 11 wherein said means for defogging comprises an air tube fitted with at least one defogging jet directing air against said window.

13. A helmet assembly comprising:

a helmet body having an inner wall defining a cavity for accommodating the head of a user; and a fluid fillable bladder having a portion which contacts the top of the head of the user and which is disposed between the head of a user and said inner wall of said helmet body to cushion the head of the user;

said fluid fillable bladder having an opening defined therein, said opening being provided about the user's face and exposing the eyes, nose and mouth of the user;

said helmet body having a neck surrounding inner wall; and said fluid fillable bladder having a neck-contacting region situated upon said neck surrounding inner wall, said region being selectively fillable with a fluid, whereby upon being filled with said fluid, said region forms a fluid-tight seal about the neck of the user;

whereby said bladder is filled with fluid when the helmet assembly is worn by the user to form a watertight seal between the bladder and the user's head and neck.

14. The helmet assembly of claim 13 wherein said helmet body comprises a front half and a back half.

15. The helmet assembly of claim 14 wherein said front half and said back half are releasably attached to each other.

16. The helmet assembly of claim 15 wherein said fluid filled bladder comprises a first bladder portion fitted to said front half of said body and a second bladder portion fitted to said back half of said helmet body.

17. A helmet assembly comprising:

an external shell having a front half and a back half, said front and back halves- being removably attachable to one another;

said front and back halves having inner walls which form a continuous inner wall when said front and back halves are attached to one another, said inner wall defining a cavity for accommodating the head of a user;

at least one adjustably fillable bladder attached to said continuous inner wall to form a cushion between the head of the user and said continuous inner wall;

at least one one neck-contacting, fluid-fillable region disposed on said front half and at least one neck-contacting, fluid-fillable region disposed on said back half, whereby said regions sealingly engage with each other to form a fluid-tight seal about the neck of the user when said front half and said back half are fitted to one another.

18. The helmet assembly of claim 17 wherein said front half and said back half are releasably attachable to each other.

19. The helmet assembly of claim 17 wherein said first and second halves are hinged to each other along a top portion of said helmet assembly, and wherein releasable fasteners are provided at a location near the bottom of said helmet assembly to lock said first half to said second half.

20. The helmet assembly of claim 18 wherein said at least one adjustably fillable bladder comprises a first bladder portion fitted to said front half of said external shell and a second bladder portion fitted to said back half of said external shell.

21. The helmet assembly of claim 20 wherein said first bladder portion and said second bladder portions are joined by a common fluid transfer section.

* * * * *